United States Patent [19]

Fisher

[11] 4,394,528

[45] Jul. 19, 1983

[54] HIGH ENERGY FUEL COMPOSITIONS

[75] Inventor: Dennis H. Fisher, Westerville, Ohio

[73] Assignee: Ashland Oil, Inc., Ashland, Ky.

[21] Appl. No.: 271,451

[22] Filed: Jun. 8, 1981

[51] Int. Cl.[3] ..... C10L 1/04

[52] U.S. Cl. ..... 585/14; 60/208; 149/109.4; 585/22

[58] Field of Search ..... 60/208, 211, 215; 149/109.4; 585/14, 22, 253

[56] References Cited

U.S. PATENT DOCUMENTS

| | | | |
|---|---|---|---|
| 4,270,014 | 3/1981 | Norton et al. | 60/208 X |
| 4,278,823 | 7/1981 | Schneider et al. | 149/109.4 X |
| 4,286,109 | 8/1981 | Norton et al. | 585/22 |
| 4,320,238 | 3/1982 | Norton et al. | 585/14 |

*Primary Examiner*—Leland A. Sebastian

*Attorney, Agent, or Firm*—William Kammerer

[57] ABSTRACT

A high density liquid hydrocarbon fuel composition singularly suited for propelling turbojet limited volume missile systems designed for shipborne deployment. The contemplated fuels are basically composed of the saturated analogues of dimers of methyl cyclopentadiene and of dicyclopentadiene and optionally include the saturated analogues of the co-trimers of said dienes or the trimers of cyclopentadiene. The various dimers and trimers are combined in a relative relationship to provide optimal performing fuels for the indicated purpose.

4 Claims, No Drawings

HIGH ENERGY FUEL COMPOSITIONS

BACKGROUND OF THE INVENTION

1. Field of the Invention

This invention relates to synthetically derived high density liquid hydrocarbon fuel compositions.

2. Description of the Prior Art

High density liquid hydrocarbon fuels are characterized in having a net volumetric heat of combustion in excess of about 140,000 BTU/gal. A high density or energy fuel is essentially required for fueling turbojet and ramjet propelled limited volume missile systems. Beyond the need for a fuel of high energy content in order to maximize range performance of the missile, there are other critical requirements in the forefront, depending in the main, on the manner in which the missile is to be deployed. For instance in airborne deployment, the fuel must exhibit a combination of a very low freeze temperature, easy ignitability in terms of its flash point and be acceptably fluid at the low temperatures encountered. On the other hand shipborne deployment requires the use of a fuel having a relatively high flash point for safety reasons but at the same time, there is a limit whereby the low temperature properties noted for airborne deployment can be sacrificed.

A high density fuel of the foregoing type does not occur in nature but rather must be chemically synthesized. Essentially all of the current generation of such fuels commonly feature a norbornane moiety having an additional saturated cyclic hydrocarbon appendage. Such appendages include the norbornane structure itself in the case of the most exotic of these fuels; viz., RJ-5, derived from dihydrodi(norbornadiene). In some instances only a specific stereo isomer of the synthesized compound represents a suitable fuel from the standpoint of having the requisite physical properties.

The isomerized hydrogenated dimer of methyl cyclopentadiene, commonly referred to as RJ-4, currently represents the designated high density fuel for propelling shipborne missile systems. The principle drawback of this fuel resides in the fact that it is a complex mixture of isomers necessitating tedious processing in order to obtain a product having a flash point desirably not in excess of about 150 and yet having a heat content within specification. The foremost objective of the present invention is to provide a composite fuel based on a substantial to a major RJ-4 component further containing other like high density fuels designed to impart optimal physical properties to the overall composition. A correlative objective is that of employing as the RJ-4 component of the composite fuel an isomeric mixture of the indicated hydrogenated derivatives exhibiting the highest heat value associated with such mixtures.

SUMMARY OF THE INVENTION

In accordance with this invention a composite high density liquid hydrocarbon fuel is provided for fueling limited volume turbojet missile systems designed for the ship-borne deployment thereof. Established critical specifications for a fuel of this type include a flash point of at least 140° F.; a net heat of combustion of at least about 140,000 BTU/gal.; and a viscosity not in excess of about 30 cps at 0° F.

In one embodiment of the invention a fuel of the foregoing type consists essentially of from about 60–90 wt. % RJ-4 and a correspondingly minor amount of exo-tetrahydrodicyclopentadiene (JP-10). In a further embodiment a hydrogenated co-trimer of cyclopentadiene and methyl cyclopentadiene or hydrogenated trimer of cyclopentadiene is included in the aforesaid compositions in an amount to increase significantly the overall heat value while maintaining the requisite low temperature viscosity characteristics. Particularly exemplary of the latter compositions are those consisting essentially of 30–60 wt. % RJ-4; 30–40 wt. % JP-10; and 10–30 wt. % of the indicated hydrogenated co-trimer or trimer.

DESCRIPTION OF THE PREFERRED EMBODIMENTS

The various components of the composite fuels contemplated herein are well documented in the prior art and as a matter of fact, of these, RJ-4 and JP-10 are produced commercially. Notwithstanding the foregoing, a brief description of the preferred method for preparing the various fuel components will be given. This will importantly serve to point up the best mode contemplated for practising the present invention.

As indicated the starting material for the production of RJ-4 is the dimer of methyl cyclopentadiene or a mixture essentially composed of said dimer. The dimer is first hydrogenated preferably in a two-stage operation. In the first stage, the 8, 9 positions of the dimer are hydrogenated at a temperature generally in the order of about 120° C. The dihydro derivative is relatively thermally stable, thus permitting the use of a substantially higher temperature in the second stage; namely, in the order of about 215° C. to complete hydrogenation. Hydrogenation pressure conditions range from about 20 to 35 atms and conventional metal hydrogenation catalysts are applicable.

The resultant tetrahydro derivative is composed of a plurality of positional isomers existing essentially as the endo-stereo isomer. In order to obtain a suitable fuel, the tetrahydro derivative is isomerized resulting in a complex mixture of the endo and exo isomers of the various positional isomers. From the standpoint of the best mode for practising the present invention, it is preferred to effect isomerization by a relatively mild thermal procedure. Thus such isomerization is accomplished by heating the tetrahydro dimer with a mild acidic catalyst at 180°–220° C. for from 1 to 4 hours.

Isomerized products prepared in this manner exhibit maximum heat content whereas a more severe thermal treatment or use of strong acidic catalysts results in an isomeric mixture of progressively lower density, and thus heat content, with concomitant lower flash point and improved low temperature viscosity characteristics. However, the composite fuels of this invention are primarily designed so as to take advantage of the highest heat content associated with the isomeric mixture concerned. On the other hand, improved viscosity characteristics and lower flash point are achieved by the presence within the composite fuel of other like high density components, particularly representative of which is exo-tetrahydrodicyclopentadiene.

In preparing exo-tetrahydrodicyclopentadiene (JP-10) the indicated dimer in its endo-stereo form is hydrogenated following the procedure noted above for the production of RJ-4. Temperature conditions given are the same; however, the pressure conditions are somewhat more moderate, ranging from about 5–15 atms. Following hydrogenation the endo isomer of the tetrahydro derivative is isomerized to the exo form. Isomerization is carried out in the presence of a variety of acidic catalysts such as the Brönsted or Lewis acids. The Lewis acids and specifically aluminum chloride is preferred from the standpoint of inducing a comparatively rapid reaction rate. Aluminum chloride, however, has a tendency to cause the isomerization to proceed beyond the exo isomer, thereby resulting in the objectionable formation of substantial amounts of trans-decalin and adamantane. Accordingly, due care must be exercised in the utilization of this catalyst.

The extent of conversion to the exo isomer can be conveniently monitored by vapor liquid gas chromatography. Upon attaining substantially complete conversion; i.e., 98+%, the reaction mixture is cooled to about 80° C. to provide upon settling, a two-phase system thereby permitting recovery of the fuel from the sludge by decantation. The product is then fractionally distilled to provide a heart cut which consists essentially of the exo isomer.

A high energy fuel particularly suited for use in a preferred embodiment of the present invention is represented by the hydrogenated Diels-Alder trimers of cyclopentadiene and methyl cyclopentadiene. The method for preparing such trimers is set forth in U.S. Pat. No. 4,059,644. The method initially involves the partial in situ dissociation of a mixture of the dimers of cyclopentadiene and methyl cyclopentadiene to their respective monomers which then in turn randomly adduct with the dimers present in the reaction mixture to provide a trimerization product. The resultant reaction mixture is hydrogenated directly, or alternatively the trimers are recovered therefrom and hydrogenated to provide the high energy fuel.

The method taught in the aforesaid patent suffers in that approximately half of the converted product consists of tetramers and higher oligomers which are unsuitable for use as a missile fuel. An improved method for preparing the indicated trimers whereby the formation of tetramers and higher oligomers is materially reduced is set forth in U.S. application Ser. No. 176,728, filed Aug. 11, 1980 now U.S. Pat. No. 4,277,636. In accordance with the latter improvement, the trimerization reaction is carried out in the presence of an inert hydrocarbon solvent. While a variety of liquid hydrocarbons free of ethylenic unsaturation represent suitable inert solvents, the solvent of choice in contemplation of the present invention consists of JP-10, RJ-4 or mixtures thereof. Since the aforementioned high density fuels comprise components of the composite fuels of this invention, the use thereof as a solvent in carrying out the trimerization and hydrogenation reactions simplifies the distillation step called for in the eventual recovery procedure.

It also warrants mentioning in this connection that there is a small amount of co-dimers formed in the trimerization reaction. These co-dimers as well as residual unreacted dimers may be hydrogenated and recovered along with the trimers and the high density fuel solvent for preparing the applicable composite fuels. Use of the indicated dimers and co-dimers serves to reduce the cost of the final composite fuel as well as contribute to improved low temperature physical properties thereof without any significant sacrifice of heat content. Likewise useful in the practice of this invention and somewhat preferred due to its higher volumetric heat content are the hydrogenated trimers of cyclopentadiene. One must be careful, however, not to introduce these hydrogenated trimers in excess due to the overwhelming preponderance of one isomer of tetrahydrotricyclopentadiene in the mixture and its possible effect on the freeze point of the final composite fuel.

EXAMPLE

Exemplary composite fuel formulations in accordance with this invention together with the various pertinent physical characteristics associated therewith are tabulated in Table I given below. The JP-10 component of this example was a commercial lot of this fuel containing 98.5+ exo-THDCPD. The RJ-4 component was a production lot having the following characteristics.

| | |
|---|---|
| Flash Point | 170° C. |
| Visc. | |
| at −30° F. | 55 cs |
| at 0° F. | 21.1 cs |
| at 100° F. | 3.85 cc |
| $\Delta H_c$ net (BTU/gal) | 140,480 |
| Spec. Grav. | 0.9273 |

The MCPD/CPD co-trimer component was a heartcut fraction obtained from a trimerization reaction mixture prepared as generally outlined in Example III of said application Ser. No. 176,728.

TABLE I

| Sample No. | Composition (Wt. %) | $\Delta H_c$ net (BTU/gal) | Viscosity (cs) | Specific Gravity @25° F. | Flash Point |
|---|---|---|---|---|---|
| A | 33.3 JP-10<br>33.3 RJ-4<br>33.3 cotrimers | 144,420 | @0° F. 30.6<br>@100° F. 4.69 | 0.9554 | 146° F. |
| B | 35 JP-10<br>35 RJ-4<br>30 cotrimers | | @0° F. 27.96<br>@100° F. 4.46 | | 146° F. |
| C | 35 JP-10<br>40 RJ-4<br>25 cotrimers | | @0° F. 24.63<br>@100° F. 4.17 | | 146° F. |
| D | 40 JP-10<br>30 RJ-4<br>30 cotrimers | | @0° F. 26.26<br>@100° F. 4.38 | | 146° F. |
| E | 40 JP-10<br>35 RJ-4<br>25 cotrimers | | @0° F. 23.47<br>@100° F. 4.08 | | 144° F. |
| F | 40 JP-10<br>40 RJ-4<br>20 cotrimers | | @0° F. 21.06<br>@100° F. 3.85 | | 142° F. |
| G | 30 JP-10<br>60 RJ-4<br>10 cotrimers | | @0° F. 18.56<br>@100° F. 3.56 | | |
| H | 40 JP-10<br>40 RJ-4<br>20 cotrimers | 143,132 | @0° F. 21.3<br>@100° F. 3.9 | 0.9484 | 146° F. |
| I | 35 JP-10<br>40 RJ-4<br>25 cotrimers | | @0° F. 24.1<br>@100° F. 4.2 | 0.9522 | 148° F. |
| J | 40 JP-10<br>40 RJ-4<br>20 THtri (CPD) | 142,109 | @0° F. 17.6<br>@100° F. 3.6 | 0.9484 | 148° F. |
| K | 35 JR-10<br>40 RJ-4<br>25 THtri (CPD) | 144,389 | @0° F. 20.6<br>@100° F. 3.9 | 0.9535 | 148° F. |
| L | 27 JP-10<br>73 RJ-4 | 141,100 | @−30° F. 31.5<br>@0° F. 14.51<br>@100° F. 3.18 | | 143° F. |

I claim:

1. A composite high density fuel having a net heat of combustion of at least 140,000 BTU/gal., a flash point between 140° and 150° F. and a viscosity not in excess of about 30 cps at 0° F.; said fuel consisting essentially of (a) 35–90 wt. % of an isomeric mixture of tetrahydromethylcyclopentadiene dimers conforming to the physical property specifications for RJ-4; (b) 10–40 wt. % exo-tetrahydrodicyclopentadiene; and (c) 0–30 wt. % of the hydrogenated derivatives of a co-trimer of cyclopentadiene and methyl cyclopentadiene or a trimer of cyclopentadiene.

2. The composite high density fuel according to claim 1 consisting essentially of 60–90 parts by weight of an isomeric mixture of tetrahydromethylcyclopentadiene dimers conforming to the physical property specifications for RJ-4 and correspondingly from 40–10 parts by weight exo-tetrahydrodicyclopentadiene.

3. A composite high density fuel according to claim 1 consisting essentially of 70–80 parts by weight of an isomeric mixture of tetrahydromethylcyclopentadiene dimers conforming to the physical property specifications for RJ-4 and correspondingly from 30–20 parts exo-tetrahydrodicyclopentadiene.

4. A composite high density fuel according to claim 1 consisting essentially of (a) 30–60 wt. % of an isomeric mixture of tetrahydromethylcyclopentadiene dimers conforming to the physical property specifications for RJ-4; (b) 30–40 wt. % exo-tetrahydrodicyclopentadiene; and (c) 10–30 wt.% of the hydrogenated derivatives of a co-trimer of cyclopentadiene and methyl cyclopentadiene or the trimers of cyclopentadiene.

* * * * *